US005147491A

United States Patent [19]

Thomas et al.

[11] Patent Number: 5,147,491

[45] Date of Patent: Sep. 15, 1992

[54] FORM, FILL AND SEAL PROCESS AND DEVICE

[75] Inventors: John T. Thomas, Clover; Claude E. Monsees, Fort Mill, both of S.C.

[73] Assignee: Roberts Systems, Inc., Charlotte, N.C.

[21] Appl. No.: 378,461

[22] Filed: Jul. 11, 1989

Related U.S. Application Data

[63] Continuation of Ser. No. 140,963, Jan. 4, 1988, abandoned, which is a continuation of Ser. No. 825,054, Jan. 31, 1986, abandoned.

[51] Int. Cl.[5] ..... B32B 31/18

[52] U.S. Cl. ..... 156/251; 53/58; 53/75; 53/451; 53/479; 53/507; 53/551; 53/552; 156/358; 156/378; 425/136; 425/154

[58] Field of Search ..... 53/58, 75, 373, 451, 53/479, 507, 552, 551; 156/360, 64, 251, 358, 359, 378, 575, 350, 351, 365; 425/136, 138, 154, 500

[56] References Cited

U.S. PATENT DOCUMENTS

| | | | |
|---|---|---|---|
| 3,564,657 | 2/1971 | Aoki | 425/154 |
| 4,348,851 | 9/1982 | Prakken | 53/552 |

*Primary Examiner*—Tim Heitbrink
*Attorney, Agent, or Firm*—Bailey & Hardaway

[57] ABSTRACT

A detection apparatus is provided in a form, fill and seal operation to detect the position of sealing jaws with respect to one another during the sealing process.

5 Claims, 1 Drawing Sheet

FORM, FILL AND SEAL PROCESS AND DEVICE

This application is a continuation, of application Ser. No. 140,963, filed Jan. 4, 1988 now abandoned, which is a continuation of application Ser. No. 06/825,054, filed Jan. 31, 1986 now abandoned.

BACKGROUND OF THE INVENTION

This invention relates generally to the art of packaging and more particularly to the art of sealing form, fill and seal packages.

Many food and other perishable products are packaged in conventional form, fill and seal-type packages. Such packages are well known and an example of such a process is disclosed in U.S. Pat. No. 4,348,851 the disclosure of which is hereby incorporated by reference. During the production of form, fill and seal packages it is not unusual to find product entrapped in the cross seal area of such packages with the result being a package which leaks and which should be rejected.

The above reference U.S. patent partially confronts this problem by compressing the package to determine the presence of a leak.

Compression techniques, however, would not always successfully detect the presence of product within the seal area, nor wrinkles within the seal area. An additional problem which occurs during sealing is the contamination of the sealing jaws themselves which would not necessarily be detected by a compression test as described above.

SUMMARY OF THE INVENTION

It is thus an object of this invention to provide a detection apparatus for use in form, fill and seal which detects the presence of product within the seal area.

It is a further object of this invention to provide such a detection apparatus which detects the presence of packaging film wrinkles within the seal area.

It is a further object of this invention to provide such a detection device which detects contamination of the seal jaws themselves.

These as well as other objects are accomplished by an improvement to a form, fill and seal apparatus which provides means for detecting the position of sealing jaws with respect to one another during the sealing operation.

DETAILED DESCRIPTION

Figures 1, 2:
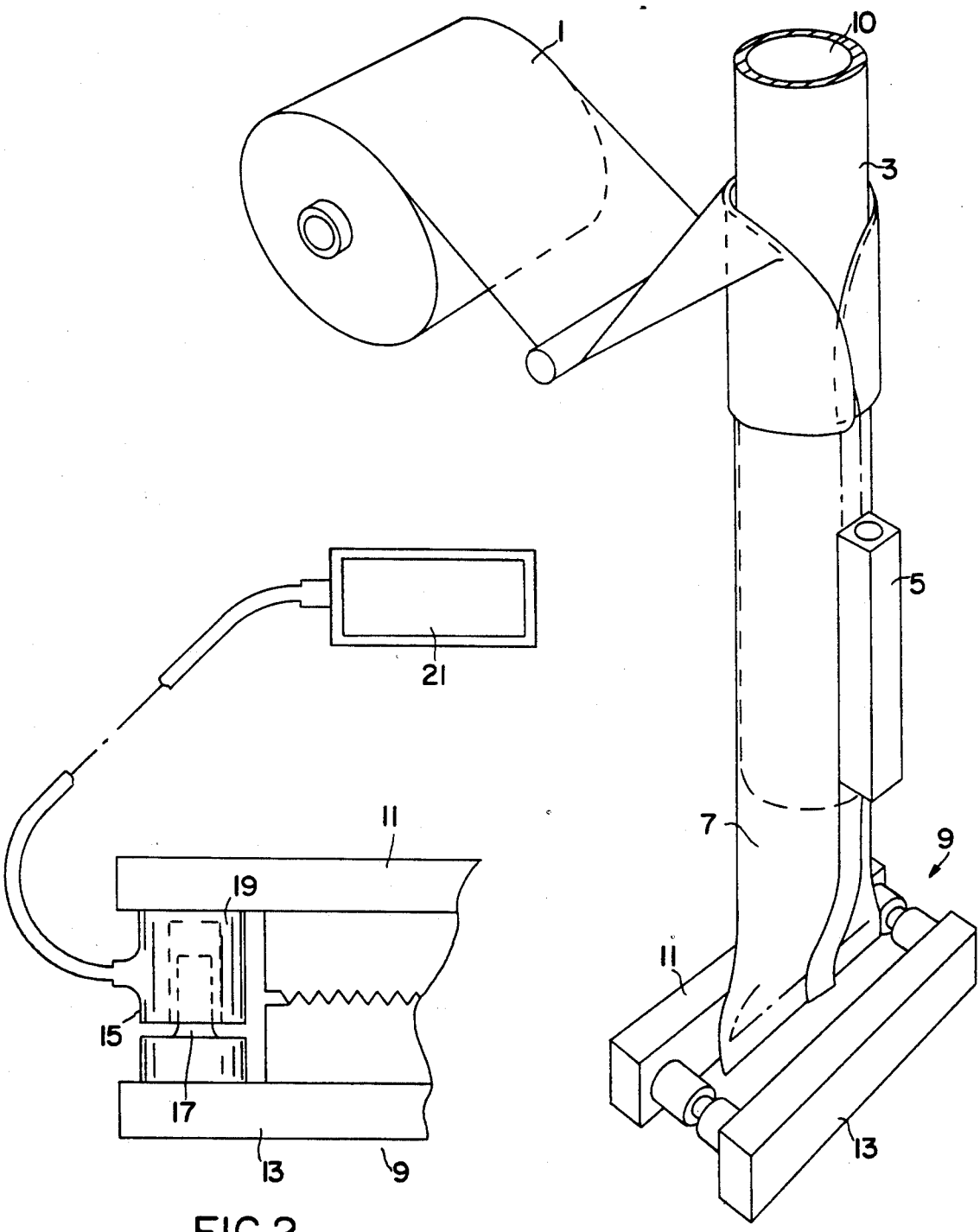
FIG. 1 of the drawings schematically illustrates the form, fill and seal process.
FIG. 2 of the drawings is a plan view of sealing jaws utilized in carrying out this invention.

In accordance with this invention it has been found that by providing detection means to measure the proximity of sealing jaws with respect to one another during the sealing operation of a form, fill and seal process that defective products may be predictably and consistently detected. Such defects include detection of product within the seal area, wrinkled packaging film, as well as contaminated jaws. Various other advantages and features will become apparent from a reading of the following description given with reference to the various figures of drawing.

FIG. 1 of the drawings schematically illustrates conduct of a form, fill and seal operation. A source of film 1 is conventionally placed about a mandrel 3 where sealing means 5 seal the thermoplastic film into a tube 7. A source of product 10 is provided to drop a predetermined quantity of product through mandrel 3 and thus into tube 7.

Tube 7 is periodically sealed by a second sealing means or sealing jaws 9 which come together for the purpose of sealing the tube and severing one packaged product from the next following package.

Sealing jaws 9 constitute the area of improvement of this invention whereby means are provided to detect the position of one sealing jaw with respect to another during the sealing process, that is, the point in time when the sealing jaws are actually sealing and severing film.

By detecting the proximity of one jaw 11 with respect to the other jaw 13 variations in sealing distances can be determined. Such variations indicate the presence of product within the seal area, as well as folds or actual contamination of the jaws themselves which prevents the jaws from moving to a close proximity during the sealing process. Any one of these defects may result in a defective seal which likely would not prevent the product from being exposed to exterior atmosphere during movement through the marketing chain.

A closeup view of sealing jaws 9 is illustrated in FIG. 2 of the drawings to illustrate a preferred apparatus and process in accordance with this invention. As illustrated in FIG. 2 of the drawings sealing jaws 9 have attached thereto a linear differential transformer 15 such that upon movement of the jaws toward one another a core 17 is placed into the center of a coil 19. Such linear differential transformers are well known in the art and it is known that the greater the distance that the core 17 travels into coil 19 the greater the output of the coil and such output may be detected by means 21. Thus, when the sealing jaws do not travel to a predisposed position the output of means 21 indicates such shortcoming. It is readily apparent that detection means such as 21 may be incorporated into an alarm system to stop movement of the form, fill and seal packaging so as to correct the defect and discard the defective package.

Additional means which are equivalent to means 15 include other well known measurement devices such as proximity switches, mechanical switches, linear encoders and sonar device. An additional detection means may comprise the use of ultrasonic power to excite the seal jaws with response varying when product is trapped within the sealing jaws.

It is thus seen that this invention provides means for detecting defects within the seal area of a form, fill and seal apparatus. Such defects include product within the seal area, wrinkled film, as well as contaminated sealing jaws. As many variations will become apparent from a reading of the above disclosure which is exemplary in nature, such variations are included within the spirit and scope of this invention as defined by the following appended claims.

What is claimed is:

1. In a process of producing a form, fill and seal package wherein a thermoplastic packaging material is formed into a tube filled with product and sealed to complete the package, the improvement comprising:

detecting distance between said sealing jaws having said tube therebetween during the sealing thereof; and activating an alarm if said distance between said sealing jaws is not in conformity with a predetermined distance.

2. The improvement according to claim 1 wherein a linear differential transformer is utilized to detect proximity of one of said sealing jaws with respect to another of said sealing jaws.

3. A process of forming a form, fill and seal package comprising the steps of:

providing a film of thermoplastic material;

wrapping said film of thermoplastic material about a mandrel;

heat sealing said thermoplastic film into a tubular configuration about said mandrel;

feeding a product through said mandrel and into said tubular form;

relatively moving sealing jaws about both sides of said tubular form to heat seal opposing sides of said tubular form; and detecting failure of said sealing jaws to adequately heat seal said opposing sides during said sealing step thereby indicating that foreign matter is present between said sealing jaws.

4. In a form, fill and seal apparatus wherein means are provided for moving a thermoplastic film of a packaging material and wrapping such film about a mandrel, a sealing means for sealing film into a tube about the mandrel, feeding means for feeding product through the mandrel and into the tube of thermoplastic packaging material, sealing jaws about the tube to seal the tube with product therein into a unitary package, the improvement comprising:

means for detecting distance between said sealing jaws during sealing of a package when film is between said sealing jaws for the sealing thereof; and additional detection means for detecting if the distance between said sealing jaws does not conform to a predetermined distance thus indicating that a package has been improperly sealed.

5. The improvement according to claim 4 wherein said means for detecting distance between said sealing jaws during sealing comprises a linear differential transformer.

* * * * *

UNITED STATES PATENT AND TRADEMARK OFFICE

CERTIFICATE OF CORRECTION

PATENT NO. : 5,147,491

DATED : September 15, 1992

INVENTOR(S) : JOHN T. ROBERTS AND CLAUDE F. MONSEES

It is certified that error appears in the above-indentified patent and that said Letters Patent is hereby corrected as shown below:

On the Title page:

Inventors: John T. Roberts, Clove; Claude F. Monsees, Fort Mill, both of South Carolina.

Signed and Sealed this

Second Day of November, 1993

*Attest:*

Bruce Lehman

BRUCE LEHMAN

*Attesting Officer*

*Commissioner of Patents and Trademarks*